US005220720A

United States Patent [19]

Becker et al.

[11] Patent Number: 5,220,720

[45] Date of Patent: Jun. 22, 1993

[54] METHOD TO PRECISELY POSITION ELECTROMAGNETIC RELAY COMPONENTS

[75] Inventors: Norman J. Becker, East Detroit; Tat H. Leung, Southfield, both of Mich.; Jeffery L. Moore, Zanesville, Ohio; Vytas J. Radze, Plymouth, Mich.

[73] Assignee: United Technologies Corporation, Hartford, Conn.

[21] Appl. No.: 761,200

[22] Filed: May 13, 1991

Related U.S. Application Data

[62] Division of Ser. No. 591,313, Oct. 1, 1990, Pat. No. 5,038,126.

[51] Int. Cl.[5] ..... H01F 7/06

[52] U.S. Cl. ..... 29/593; 29/602.1; 29/606

[58] Field of Search ..... 29/602.1, 606, 593, 29/622; 335/202, 128, 281

[56] References Cited

U.S. PATENT DOCUMENTS

| | | | |
|---|---|---|---|
| 3,277,558 | 10/1966 | Shaffer, Jr. | 29/593 |
| 3,694,912 | 10/1972 | Sprando et al. | 29/602.1 |
| 4,596,972 | 6/1986 | Knight et al. | 335/281 |
| 4,720,909 | 1/1988 | Knight et al. | 29/606 |
| 4,749,977 | 6/1988 | Prouty et al. | 29/606 X |

FOREIGN PATENT DOCUMENTS

| | | |
|---|---|---|
| 0355817 | 8/1989 | European Pat. Off. . |
| 1903595 | 2/1964 | Fed. Rep. of Germany . |
| 2338564 | 1/1977 | France . |
| 2517877 | 11/1982 | France . |
| 2072949 | 3/1980 | United Kingdom . |

*Primary Examiner*—Carl E. Hall

[57] ABSTRACT

An electromagnetic relay 38 (FIG. 2) includes a cylindrical core 42 concentrically positioned within a coil assembly 40 and press fit into a frame 50, a resiliently mounted armature assembly 56, and electrical contacts 66,68, one mounted on the armature assembly 56 and one disposed in a fixed relationship to the frame 50. The coil assembly 40 is secured to the frame 50 by the use of extrusions 54 which precludes the need for a core head 24 and crush ribs 26 (FIG. 1). After assembling the relay 38, the core 42 is positioned by pressing the armature assembly 56 directly opposite the core 42 until the core 42 travels a predetermined distance beyond the electrical contact point for the contacts 66,68. This method ensures precise positioning of the functional components and negates the accumulation of manufacturing tolerances in the relay 38.

2 Claims, 1 Drawing Sheet

METHOD TO PRECISELY POSITION ELECTROMAGNETIC RELAY COMPONENTS

DESCRIPTION

This is a division of application Ser. No. 07/591,313, filed Oct. 1, 1990, now U.S. Pat. No. 5,038,126.

TECHNICAL FIELD

This invention relates to electromagnetic relays, and more particularly to precise positioning of the components of relays to ensure proper functioning.

BACKGROUND ART

Electromagnetic relays are well known and have found a variety of useful applications as switching devices. A typical relay is mounted on a base and consists of a frame, a coil assembly consisting of a bobbin with a coil circumferentially wound around the bobbin, a core concentrically located within the coil assembly, a spring-loaded armature assembly, and two electrical contacts, one on the armature assembly and one secured to either the base or bobbin. A relay performs its switching function when the coil is energized, creating a magnetic field which closes the gap between the armature assembly and the core, causing the contact on the armature assembly to make with the contact on the base or bobbin and thereby closing an electrical circuit. When the coil is de-energized the armature assembly springs back to its initial position, the contacts separate and the circuit is opened.

Relative positioning of the various components of a relay is vital to its proper functioning and must be taken into account in order to optimally design a relay. More specifically, the positioning of the core relative to the armature assembly must be precise in order to ensure that the contacts make, and the circuit closes, when the coil is energized and that the contacts separate, and the circuit opens, when the coil is de-energized. Generally the core is positioned with a specific amount of overtravel so that there is sufficient contact force between the contacts to pass electricity efficiently, with the required amount of overtravel being dependant on the specific relay design. Unfortunately, manufacturing tolerances have made the precise positioning of the core difficult to achieve in practice and this has lead to a higher manufacturing rejection rate for relays than is desired.

Understandably, the process of manufacturing relays has been an area of much activity. Recent techniques, as described in U.S. Pat. No. 4,596,972 and 4,749,977, have focused on positioning the core during fabrication of a relay by aligning the core head with the pivot point of the armature assembly. The core head is also used to secure the bobbin into position by having the core head press down on crush ribs attached to the bobbin. Crush ribs are necessary to decrease the likelihood of deformation of the bobbin which, if this occurred, could alter the position of the contact mounted on the bobbin. After this alignment the remainder of the relay is assembled (including armature and contacts). While this design may be an improvement over previous designs, it still allows for errors due to manufacturing tolerances of the armature assembly and any manufacturing tolerance errors introduced during the assembling of the remainder of the relay. A post-assembly measurement of relative positions of the components is then required in order to assure proper functioning. If a relay does not function properly corrective measures must be taken, such as attempting to reposition the contacts or machining of the core. If the corrective measures are insufficient the relay must be scrapped.

DISCLOSURE OF INVENTION

Objects of the invention include precise positioning of the components of a relay to insure proper functioning.

According to the invention, the positioning of a relay core relative to the armature assembly can be set, after completely assembling each individual relay, by using an electrical signal reference based on the point at which the contacts electrically make contact. According further, the relay core is press fit into an aperture in the frame, by application of a pressing tool to the armature assembly directly opposite the core, a predetermined distance beyond the electrical contact point for a contact on the armature assembly and a stationary contact disposed in a fixed relationship to the frame. In this way the effect of errors induced by manufacturing tolerances for each relay can be negated and there is no requirement for further testing or corrective measures to achieve proper functioning.

The foregoing and other objects, features and advantages of the present invention will become more apparent in light of the following detailed description of exemplary embodiments thereof, as illustrated in the accompanying drawings.

BEST MODE FOR CARRYING OUT THE INVENTION

Prior Art

Figure 1:
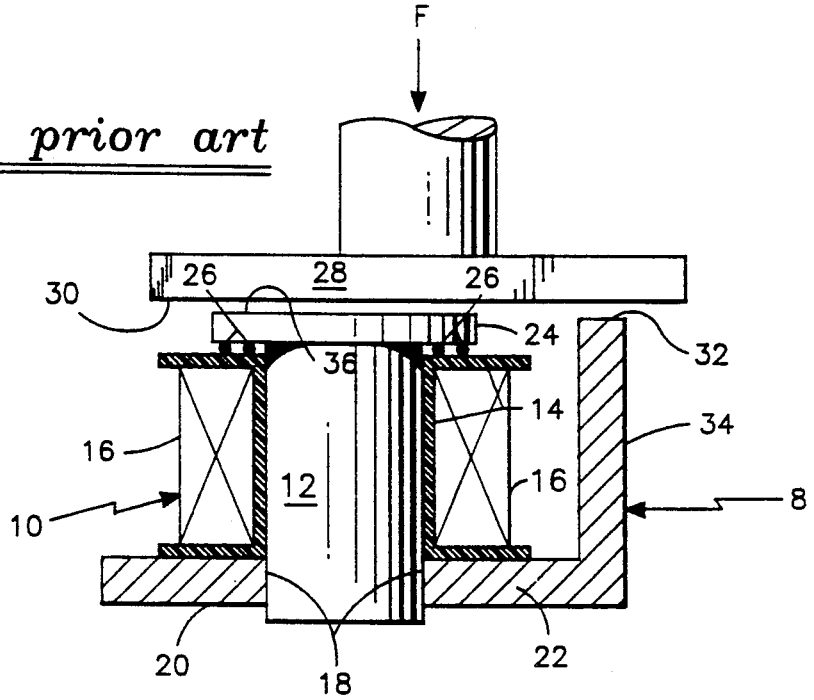
FIG. 1 prior art
FIG. 1 is a partially sectioned side elevation view of a relay as its core is being positioned in accordance with prior art.

Referring now to FIG. 1, a relay 8 is shown in a partially assembled state. A core 12 is inserted through a coil assembly 10 which consists of a bobbin 14 with a coil 16 circumferentially wound around it, and press fit through an aperture 18 in a bottom leg 20 of an L-shaped frame 22 with a core head 24 which secures the bobbin 14 into position on the frame 22 by pressing down on a plurality of crush ribs 26 attached to the bobbin 14. The core 12 is press fit into the frame 22 by a force-applying tool 28 with a face 30 wide enough to engage both the core head 24 and a pivot point 32 on a side leg 34 of the frame 22. The core 12 is positioned by the force-applying tool 28 engaging the core head 24 and forcing the core 12 into the aperture 18 until the force-applying tool 28 engages the pivot point 32, at which point the pivot point 32 and top surface 36 of the core head 24 are aligned and the force applying tool 28 is removed. The remainder of the relay 8 is then assembled and the completed relay (not shown) is tested for proper functioning. Since the core 12 is positioned prior to assembling all the functional components, any manufacturing tolerances associated with components added to the relay 8 after the alignment will accumulate into the completely assembled relay and must be corrected for, if possible.

EMBODIMENT OF THE INVENTION

Figure 2:
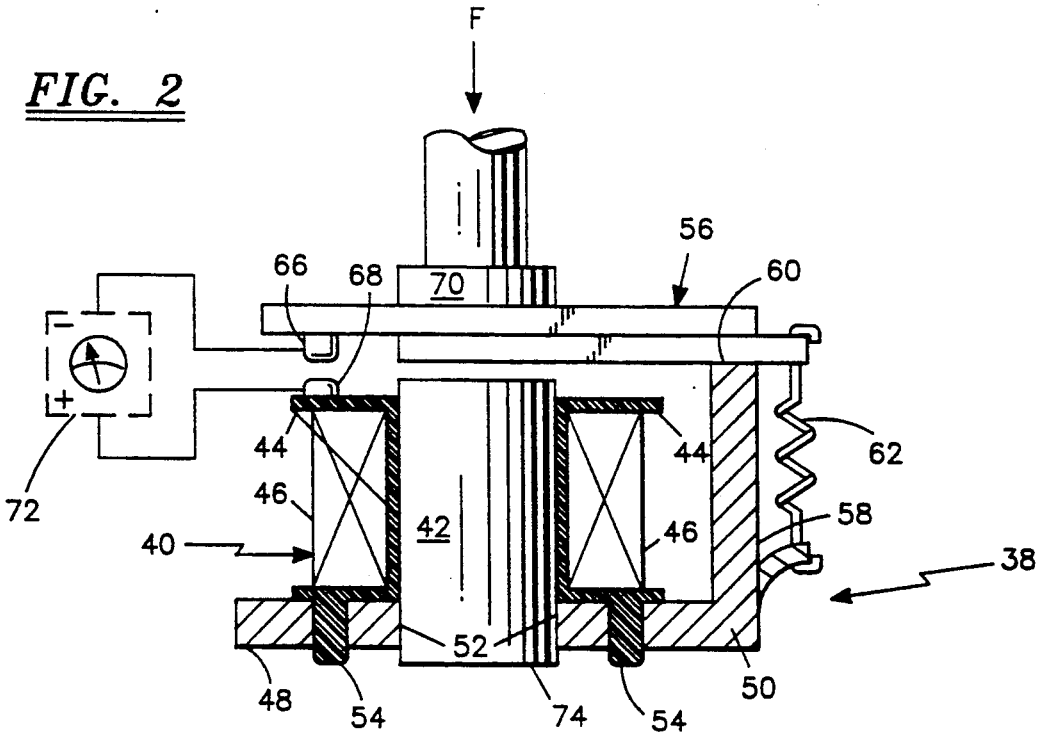
FIG. 2 is a partially sectioned side elevation view of a relay as its core is being positioned in accordance with the present invention.

Referring to FIG. 2, the present invention negates the effect of the accumulation of manufacturing tolerances in a relay 38. A cylindrical core 42 is concentrically positioned within a coil assembly 40, consisting of a bobbin 44 and coil 46, and is press fit into a bottom leg 48 of an L-shaped frame 50 with the interference for the press fit being provided by an aperture 52 in the bottom leg 48 cut slightly smaller than the diameter of the core 42. The coil assembly 40 is secured to the bottom leg 48 by a plurality of extrusions 54 which are spun down to create a tight fit. The use of the extrusions 54 precludes the need for the core head 24 and crush ribs 26 (FIG. 1) and thereby eliminates this limitation on the positioning of the core 42 and eliminates the risk of deformation of the bobbin 44 caused by the pressure from the core head 24. An armature assembly 56 is attached to a side leg 58 of the frame 50 at a pivot point 60 by a spring 62 with an electrical contact 66 positioned over a stationary electrical contact 68 rigidly mounted on the bobbin 44. In alternative embodiments the stationary contact 68 may be disposed in a fixed relationship to a base (not shown) or any other stationary structure, as desired.

Once completely assembled, a force-applying tool 70 engages the armature assembly 56 directly opposite the core 42 and forces the core 42 into the coil assembly 40 and bottom leg 48 until the electrical contacts 66,68 make, which action is monitored electrically by a suitable continuity tester 72, this point being designated a zero reference for the relay 38. The force-applying tool 70 is then applied a further predetermined distance in order to insert the core 42 until the proper amount of overtravel of the armature assembly is achieved, at which point the core 42 may be secured into place, such as by laser welding or other bonding of the lower surface 74 of the core 42 to the bottom leg 48. After securing the core 42 into its final position, the force-applying tool 70 is removed, the armature assembly 56 is allowed to spring back to its initial position, and the manufacture of the relay 38 is complete. The entire process of positioning the core 42 may be automated by utilizing a control system for the force-applying tool 70 which uses the outputs from the electrical monitoring of the contacts 66,68 and a predetermined amount of overtravel in order to determine insertion depth of the core 42. Since no further assembling of the relay 38 is required there will be no additional tolerance errors introduced to interfere with the proper functioning and since the reference used in this method is the making of an electrical connection between the contacts 66,68, which is the ultimate parameter to be controlled, proper positioning of the vital components of the relay 38 is assured and no operational testing is normally required.

The relay 38 as shown in FIG. 2 illustrates a system in which the armature assembly 56 has a spring neutral initial position when the coil 46 is de-energized. The typical configuration for a relay has an additional contact, mounted directly opposite the stationary contact 68 and disposed in a fixed relationship to either the coil assembly 40 or base, which the armature assembly 56 pivots against when the coil 46 is de-energized. In alternative embodiments of the invention the additional contact or some other device may be used, or not, as is deemed appropriate, to determine the de-energized position of the armature assembly 56.

Although the invention has been shown and described with respect to exemplary embodiments thereof, it should be understood by those skilled in the art that various changes, omissions and additions may be made therein and thereto, without departing from the spirit and the scope of the invention.

We claim:

1. A method of precisely positioning the components of a relay comprising the steps of:

(1) providing a relay including
- a frame with a first leg and a second leg;
- a coil assembly secured to said frame;
- a stationary electrical contact disposed in a fixed relationship with said frame;
- a core concentrically positioned within said coil assembly and press fit through an aperture in said first leg of said frame; and
- an armature assembly resiliently pivoted on said second leg of said frame with an electrical contact positioned to make contact with said stationary electrical contact when said armature is pivoted sufficiently toward said coil assembly;

(2) monitoring, using electrical continuity monitoring means, said electrical contact on said armature assembly and said stationary electrical contact for electrical continuity between said electrical contacts; and (3) pressing said armature assembly directly opposite of said core such that said armature assembly engages said core to press fit said core into said aperture of said frame until said core travels a predetermined distance beyond the point where said electrical contacts make contact as indicated by said electrical continuity monitoring means.

2. The method of claim 1 comprising the additional step of bonding said core to said frame.

* * * * *